US010017235B2

(12) United States Patent
Pappas et al.

(10) Patent No.: US 10,017,235 B2
(45) Date of Patent: Jul. 10, 2018

(54) RETRACTABLE BOAT EXTENSION

(71) Applicants: James A. Pappas, Hilham, TN (US); Anthony Pappas, Byrdstown, TN (US); Ann L. Pappas, Hilham, TN (US); Sandra Pappas, Byrdstown, TN (US); Carolyn J. Pappas, Byrdstown, TN (US)

(72) Inventors: James A. Pappas, Hilham, TN (US); Anthony Pappas, Byrdstown, TN (US); Ann L. Pappas, Hilham, TN (US); Sandra Pappas, Byrdstown, TN (US); Carolyn J. Pappas, Byrdstown, TN (US)

( * ) Notice: Subject to any disclaimer, the term of this patent is extended or adjusted under 35 U.S.C. 154(b) by 0 days.

(21) Appl. No.: 14/959,222

(22) Filed: Dec. 4, 2015

(65) Prior Publication Data

US 2016/0159437 A1 Jun. 9, 2016

Related U.S. Application Data

(60) Provisional application No. 62/087,996, filed on Dec. 5, 2014.

(51) Int. Cl.

| | |
|---|---|
| ***B63B 27/14*** | (2006.01) |
| ***B63H 20/02*** | (2006.01) |
| ***B63B 29/06*** | (2006.01) |
| ***B63B 35/613*** | (2006.01) |
| ***B63H 20/00*** | (2006.01) |
| *B63B 29/04* | (2006.01) |
| *B63B 29/02* | (2006.01) |

(52) U.S. Cl.

CPC ..... *B63H 20/02* (2013.01); *B63B 27/146* (2013.01); *B63B 29/06* (2013.01); *B63B 35/613* (2013.01); *B63H 20/007* (2013.01); *B63B 2027/141* (2013.01); *B63B 2029/022* (2013.01); *B63B 2029/043* (2013.01); *B63B 2029/046* (2013.01)

(58) Field of Classification Search

CPC ..... A47J 2037/0777; B63B 2029/022; B63B 2003/485; B63B 3/48

See application file for complete search history.

(56) References Cited

U.S. PATENT DOCUMENTS 3,980,039 A * 9/1976 Henning ..... B63H 20/007 248/642
4,354,445 A * 10/1982 Kafka ..... B63C 3/06 114/218
4,977,848 A * 12/1990 Currey ..... B63B 29/04 114/363

(Continued)

*Primary Examiner* — Andrew Polay
(74) *Attorney, Agent, or Firm* — Global Intellectual Property Agency, LLC; Jordan Sworen

(57) ABSTRACT

A retractable boat extension. The retractable boat extension is a platform that is attachable to a boat, such as a pontoon boat, that provides additional space to transport items or lounge upon. The platform includes a sliding mechanism having an actuator for sliding relative to the boat, pedestal mounts for attaching a plurality of interchangeable accessories thereto, such as grills, fishing chairs and food preparation tables, an outboard motor mount configured to receive a variety of outboard motors including, but not limited to, trolling motors, and a mounting bracket configured to receive a forward ramp for handicapped access to the pontoon boat.

20 Claims, 9 Drawing Sheets

(56) References Cited

U.S. PATENT DOCUMENTS

| | | | | | |
|---|---|---|---|---|---|
| 5,085,164 | A * | 2/1992 | Whitton | B63B 27/14 | 114/362 |
| 5,117,940 | A * | 6/1992 | Garelick | E06C 9/10 | 114/362 |
| 5,123,372 | A * | 6/1992 | Kobayashi | B63B 27/14 | 114/362 |
| 6,298,801 | B1 * | 10/2001 | May | B63B 3/48 | 114/364 |
| 6,918,721 | B2 * | 7/2005 | Venton-Walters | B61D 45/001 | 410/102 |
| 8,056,496 | B1 * | 11/2011 | Bussa | B63B 27/146 | 114/362 |
| 2010/0163086 | A1 * | 7/2010 | Chavez | A45B 3/00 | 135/16 |
| 2014/0158038 | A1 * | 6/2014 | Johnston | B63B 27/143 | 114/355 |

* cited by examiner

RETRACTABLE BOAT EXTENSION

CROSS REFERENCE TO RELATED APPLICATIONS

This application claims the benefit of U.S. Provisional Application No. 62/087,996 filed on Dec. 5, 2014. The above identified patent application is herein incorporated by reference in its entirety to provide continuity of disclosure.

BACKGROUND OF THE INVENTION

The present invention relates to pontoon boats. More specifically, the present invention relates to extensions for pontoon boats that are attachable, retractable, and designed to provide more room for passengers, an extra space for transportation, and create more boat functionality.

Pontoon boat owners are often looking for additional space when hosting people on their pontoon boat. Besides needing the extra space to provide a more spacious and comfortable environment for their passengers, boat owners often need the additional space for conducting activities on the boat, such as food preparation, fishing, and grilling. Further, boat owners are often looking for additional space for transporting items necessary for enjoying time spent out on the water without compromising space for their passengers. Because the space on a pontoon boat is limited, there may not be enough room on any given pontoon boat for individuals to prepare food and enjoy grilling or fishing, while simultaneously providing a spacious environment for passengers. Therefore, individuals are forced to conduct all pontoon boat activities in a compact area, often creating discomfort and limited use of the boat. By expanding the pontoon boat deck area and creating a way in which to temporarily transport items outside the boat, there can be more room for passengers to lounge and enjoy their day without worrying about bumping into each other and other items. Therefore, there is a need in the prior art to create a pontoon boat extension that creates a more spacious environment for passengers, while simultaneously increasing pontoon boat functionality by creating an extra space in which many different items can be affixed to, such as food preparation tables, grills, chairs, and outboard motors, and which can also be used to transport various items.

SUMMARY OF THE INVENTION

The following summary is provided to indicate the nature of the subject matter disclosed herein. While certain aspects of the present invention are described below, the summary is not intended to limit the scope of the present invention.

In view of the foregoing disadvantages inherent in the known types of pontoon boat extensions now present in the prior art, an embodiment of the present invention provides a retractable pontoon boat extension wherein the same can be utilized for providing convenience for the user when hosting people on his or her boat and conducting activities thereon. The present invention comprises an attachable platform that is slidably adjustable relative to a pontoon boat deck via a sliding mechanism, thereby creating more space on the pontoon boat whenever desired by the boat owner. The platform includes pedestal mounts which are utilized to interchangeably connect various accessories to the platform, such as grills, tables, and chairs. The platform includes an outboard motor mount which can be flush mounted and configured to receive a variety of outboard motors. The platform further includes mounting brackets configured to receive a ramp. Finally, the platform may include strap connectors for securing items to the platform for transportation, a stowable ladder, and hand grasps that enable passengers to get onto the boat in deep waters.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
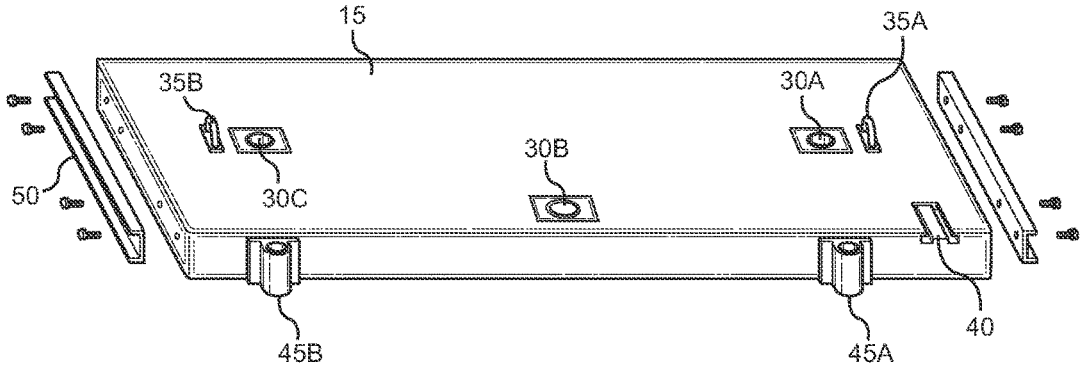
FIG. 1 shows a partially exploded view of one embodiment of the present invention.

Reference is made herein to the attached drawings. Like reference numerals are used throughout the drawings to depict like or similar elements of the retractable pontoon boat extension. For the purpose of presenting a brief and clear description of the present invention, the preferred embodiment will be discussed as used for a conventional pontoon boat. The figures are intended for representative purposes only and should not be considered to be limiting in any respect.

The present invention includes a retractable platform attached to and extending from the hull of a boat, such as a pontoon boat. In one embodiment, the retractable platform is integral to the hull. In another embodiment, the retractable platform is affixable to the hull of a boat, such as a pontoon boat, as an after-market modification. The platform comprises at least one pedestal mount, a mounting bracket, a universal outboard motor mount, and attachable mounting rails. The platform can be installed on a boat at a boat manufacturing facility or can be attached manually by the user. When manually attaching the platform to a pontoon boat, for example, the user first installs a slide-on mounting track to the underside of the pontoon boat by attaching it to the boat floor braces. The mounting track may be attached by bolting it to the floor braces at various mounting holes disposed on the mounting track. After attaching the mounting track to the floor braces of the pontoon boat, the platform is mounted thereon via the mounting rails which are attachable to the sides of the platform. The user attaches the mounting rails via various mounting holes disposed on the sides of the platform. Once attached, the mounting rail is slidably engageable with the mounting track via rollers disposed therein, thus allowing it to be inserted in the mounting track and extended or retracted manually as desired by the user via a sliding mechanism comprising an actuator. The platform, mounting track, mounting rail, and rollers can be constructed from aluminum, steel, plastic, or any other like suitable material or combination thereof.

The platform is configured to slidably attach to the undersurface of the hull of any pontoon boat and is configured to fit underneath the deck of any pontoon boat. The platform is slidably adjusted via the sliding mechanism, which actuation thereof allows it to be extended and retracted as desired. When retracted, the platform does not extend past the perimeter of the pontoon boat and is fully concealed thereby. The sliding mechanism enables the user to utilize the platform as an additional area to supplement the deck area of the pontoon boat as needed. In various embodiments of the present invention, the sliding mechanism comprises manual, pneumatic, or electronic sliding mechanisms having actuators for operation of the mechanism.

Referring now to FIG. 1, there is shown an exploded perspective view of one embodiment of the present invention with a mounting rail. This embodiment provides a platform 15, which can be removably attached to a pontoon boat. The platform 15 comprises three pedestal mounts 30A, 30B, 30C, two D-rings 35A, 35B as strap connectors, a universal outboard motor mount 40, and two mounting eyelets 45A, 45B as the mounting bracket, and an attachable mounting rail 50. In alternative embodiments, the mounting bracket comprises a piano hinge or other type of mounting bracket existing in the art.

Figure 2A:
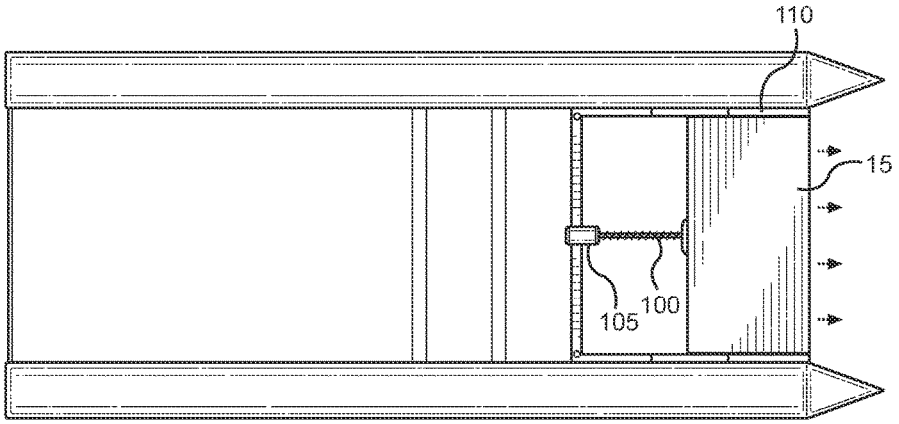
FIG. 2A shows a bottom view of one embodiment of the present invention, displaying an electrical sliding mechanism which is used to slidably adjust the platform.
Figure 2B:
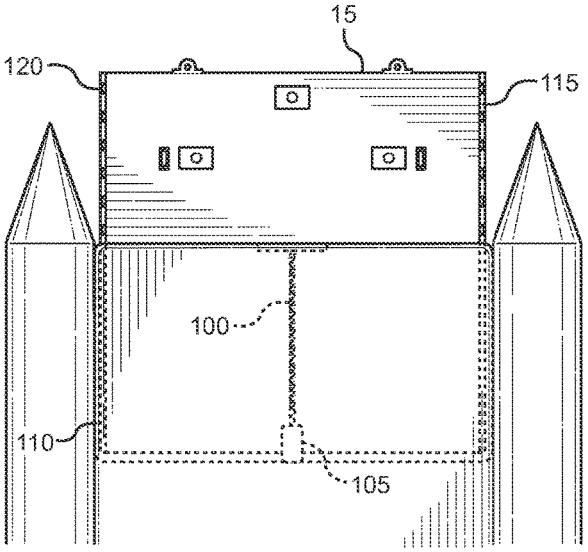
FIG. 2B shows a top phantom view of the pontoon boat in one embodiment of the present invention, displaying the platform as fully extended out from underneath the pontoon boat by the electrical sliding mechanism.
Figure 2C:
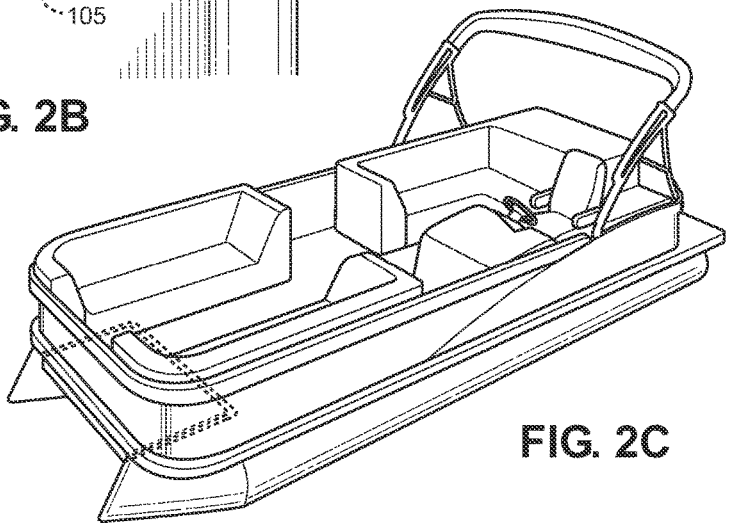
FIG. 2C shows a perspective front view of the pontoon boat with the platform 15 completely stowed underneath the pontoon boat deck by the electrical sliding mechanism.

Referring now to FIGS. 2A-2C, there is shown an electrical sliding mechanism as employed on a pontoon boat in one embodiment of the present invention. FIG. 2A shows the hull of the pontoon boat and the platform 15 as stowed and retracted by the electrical sliding mechanism. FIG. 2B shows a top phantom view of the pontoon boat, such that the platform 15 is displayed as fully extended from underneath the pontoon boat by the electrical sliding mechanism. FIG. 2C shows a perspective front view of a pontoon boat with the platform 15 completely stowed underneath the pontoon boat deck.

In the depicted embodiment, the platform 15 is slidably adjustable via a linear screw type system. The system comprises a screw 100, an actuator 105, a control, a mounting track 110, a mounting rail 115, and rollers 120. The mounting track 110 is disposed on the underside of the front portion of the pontoon boat and the mounting rail 115 is disposed on the sides of the platform 15. The mounting track 110 is configured to receive the mounting rail 115, which is slidably adjustable along the mounting track 110 via the rollers 120. The actuator 105 comprises an electrical screw drive motor that is operably connected to a control. In one embodiment, the control is disposed on the steering station of a pontoon boat so that it can be operated by the pontoon boat operator. In another embodiment, the control is a remote control unit. When activated, the actuator 105 drives the horizontal screw extension 100 in a forward motion and pushes the platform 15 horizontally out from underneath the pontoon boat. The mounting rail 115 slides along the mounting track 110 via the rollers 120. In one embodiment, the mounting track 110 further includes a locking mechanism that is configured to lock the platform 15 in its fully extended or stowed configuration.

Figure 2D:
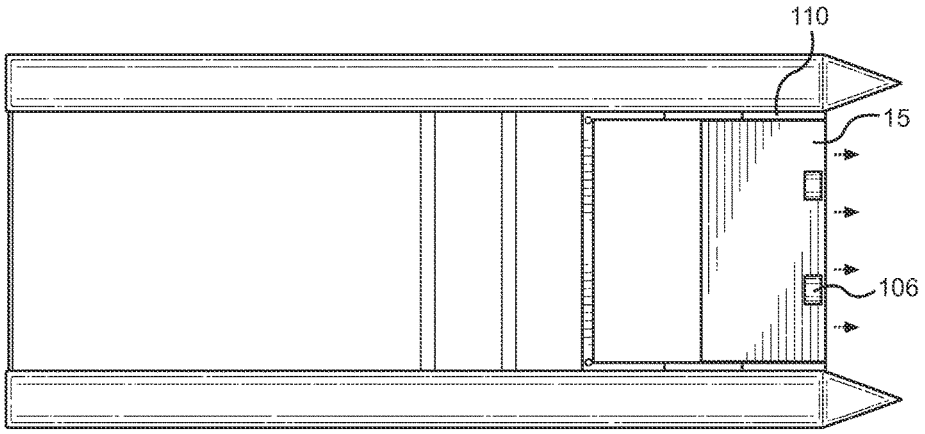
FIG. 2D shows a bottom view of one embodiment of the present invention, displaying a manual sliding mechanism which is used to slidably adjust the platform.
Figure 2E:
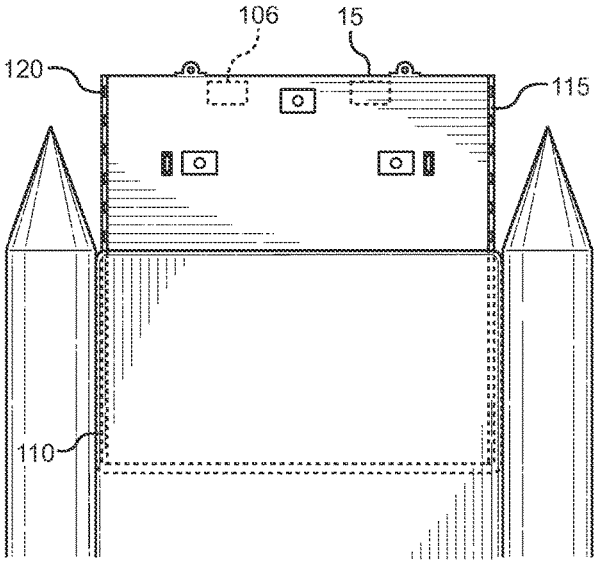
FIG. 2E shows a top phantom view of the pontoon boat in one embodiment of the present invention, displaying the platform as manually extended out from underneath the pontoon boat.

Referring now to FIGS. 2D-2E, there is shown a bottom view and top phantom view, respectively, of another embodiment of the boat extension illustrating the sliding mechanism. In the depicted embodiment, the sliding mechanism lacks a drive or other mechanism for mechanically deploying the platform 15. Rather, the sliding mechanism is manually actuated by a user such that the platform 15 can be deployable and retractable. The platform 15 includes a hand grip 106 for enabling the user to grasp the platform 15. By grasping the hand grips 106, users can pull the platform 15 out from underneath the boat or push the platform 15 back underneath the boat. When the user pushes or pulls the platform 15, the mounting rails 115 slide along the mounting track 110 via the rollers 120. In some embodiments, the mounting rails 115 comprise a locking mechanism, which locks the platform into place inside the mounting track 110.

Figure 2F:
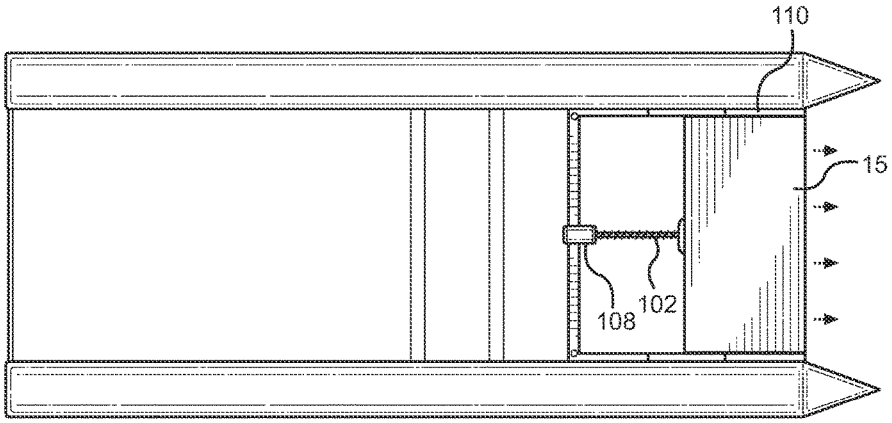
FIG. 2F shows a bottom view of one embodiment of the present invention, displaying a pneumatic sliding mechanism which is used to slidably adjust the platform
Figure 2G:
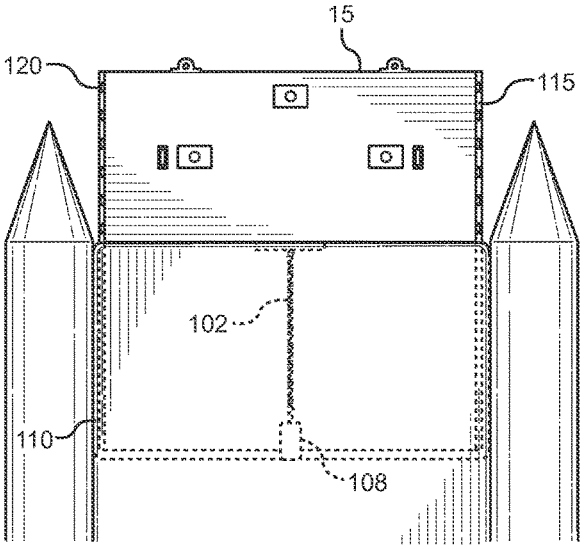
FIG. 2G shows a top phantom view of the pontoon boat in one embodiment of the present invention, displaying the platform as fully extended out from underneath the pontoon boat by the pneumatic sliding mechanism.

Referring now to FIGS. 2F-2G, there is shown a bottom view and top phantom view, respectively, of another embodiment of the boat extension illustrating the sliding mechanism. In the depicted embodiment, a pneumatic sliding mechanism is actuated to retract and extend the platform. The pneumatic sliding mechanism includes an actuator 108 comprising an pneumatic motor operably connected to an electrical control, which is located on the pontoon boat steering station in one embodiment of the present invention so that it can be operated by the pontoon boat operator. When actuated, the pneumatic motor drives a screw 102 in a forward motion, pushing the platform 15 horizontally out from underneath the pontoon boat. The mounting rail 115 slides along the mounting track 110 via the rollers 120 to its fully extended position. In some embodiments, the mounting track 110 contains a lock that holds the platform 15 in its place when in use or when not in use and stored underneath the pontoon boat.

In alternative embodiments, the platform 15 is retractable and extendable via different mounting bracket assemblies known in the art, which comprise a mounting track and a mounting rail slidably disposed in the mounting track that is capable of sliding therein via rollers. In alternative embodiments, the mounting bracket assembly may contain any number of additional mounting tracks and mounting rails slidably adapted to interact with one another for the purposes of retracting and extending an item and creating a stronger bracket assembly for sustaining more weight thereon.

Figure 3A:
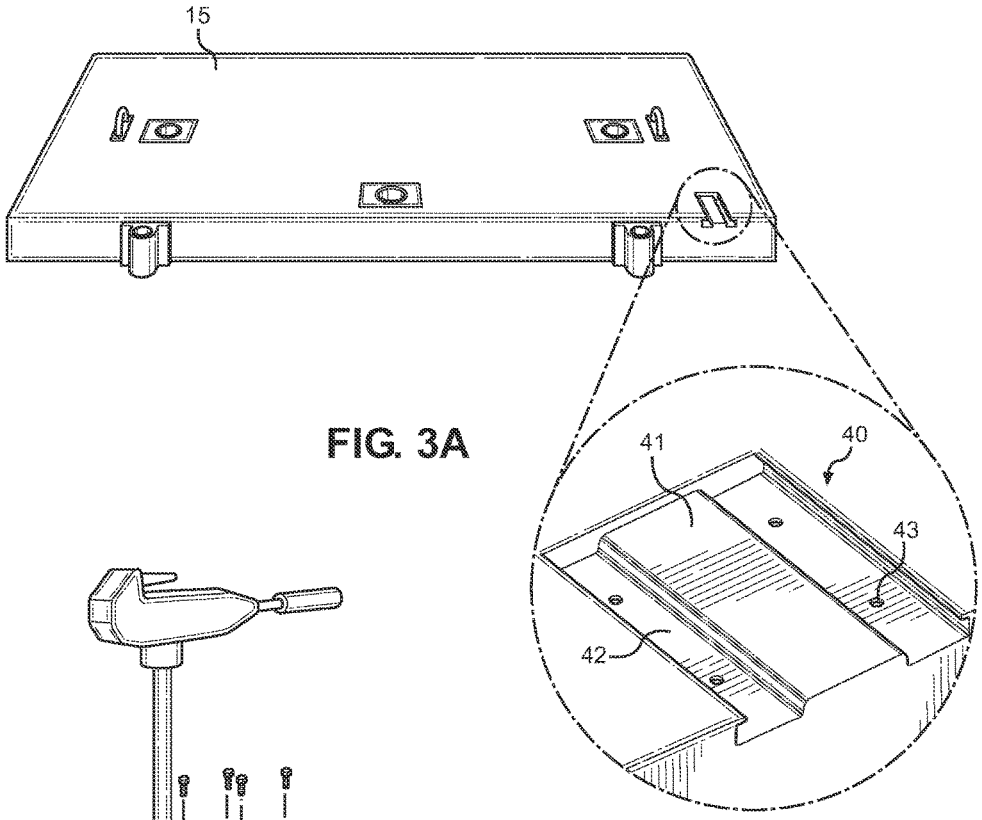
FIG. 3A shows a detail view of a universal outboard motor mount in one embodiment of the present invention.
Figure 3B:
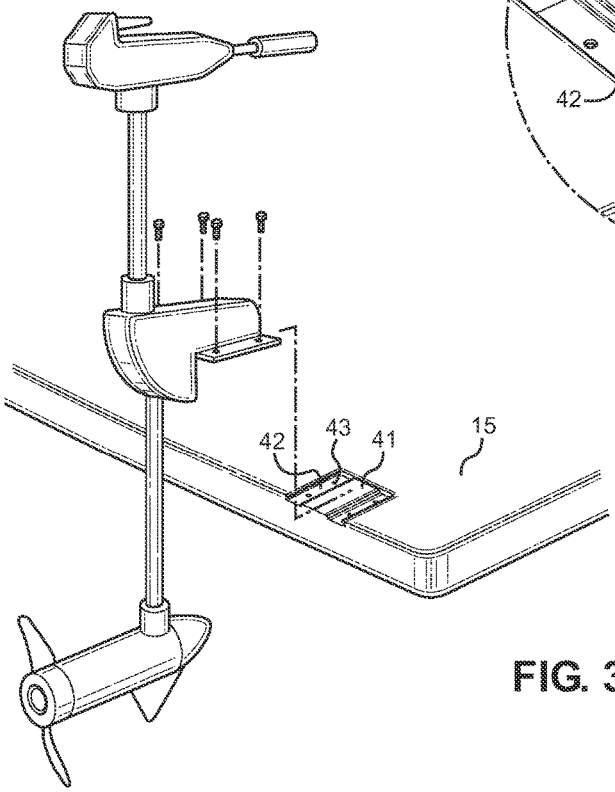
FIG. 3B shows an exploded view of an outboard motor mount with an outboard trolling motor being mounted thereon.

Referring now to FIGS. 3A-3B, there is shown a perspective detail view of the universal outboard motor mount 40 in one embodiment of the present invention and an exploded view of the mount 40 with an outboard trolling motor being mounted thereon. In the depicted embodiment, the mount 40 is flush to the surface of the platform 15 such that it does not cause a tripping hazard. The mount 40 includes an interior portion 41 and pair or channels 42 with mounting holes 43 thereon. The interior portion 41 and channels 42 are configured to receive the mounting bracket of an outboard motor. The mounting holes 43 are adapted for receiving fasteners, such as screws or bolts, for installing and fastening the outboard motor to the platform 15. The outboard motor may be any variety of outboard motors commonly used for boating, such as a trolling motor. In alternative embodiments, the mounting holes are adapted to correspond to a specific type of outboard motor, thereby only being able to receive that outboard motor. The mount 40 can be constructed of aluminum, steel or any other like suitable material.

Figure 3C:
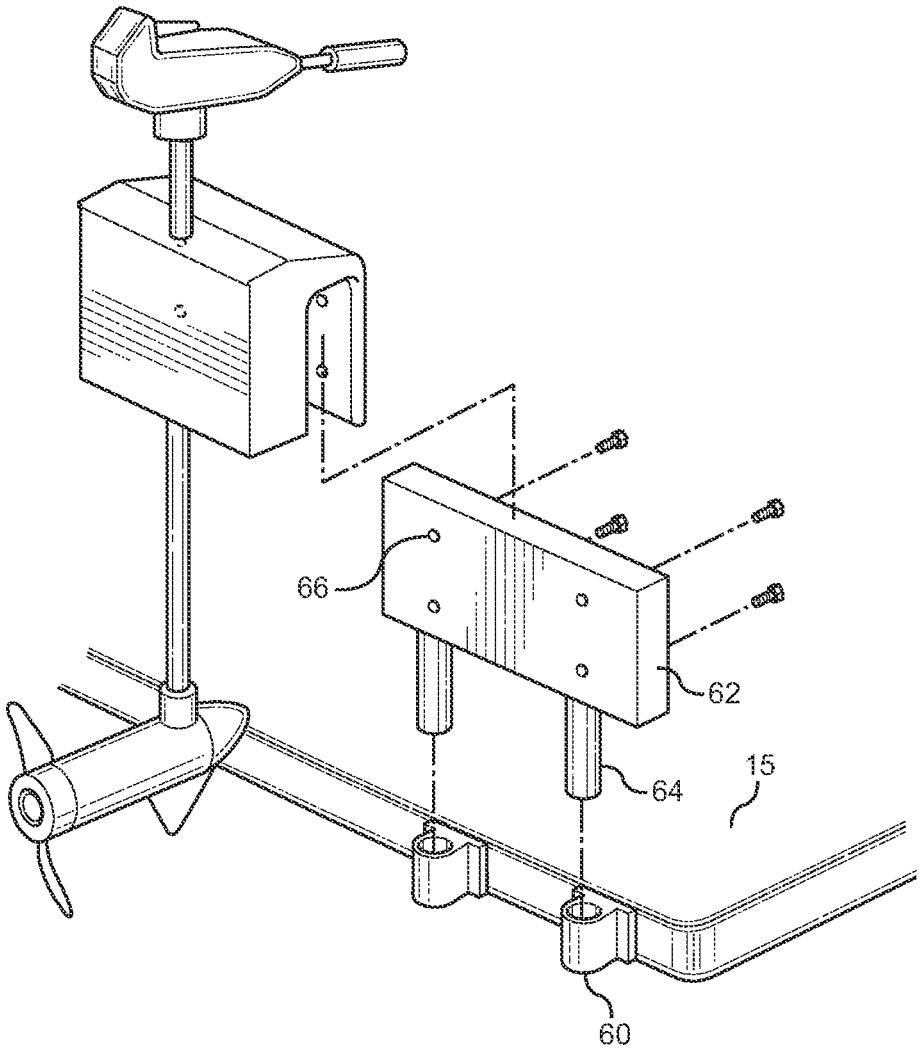
FIG. 3C show an exploded view of a motor mount plate with an outboard trolling motor being mounted thereon.

Referring now to FIG. 3C, there is shown a perspective view of another embodiment of the present invention. In the depicted embodiment, the outboard motor mount comprises mounting eyelets 60, configured to horizontally receive an outboard motor mount plate 62 via mounting rods 64 disposed on the plate 62. The mount plate 62 comprises various mounting holes 66 adapted for receiving corresponding outboard motors, such as trolling motors. The mount plate 62 is interchangeable with other mount plates, as desired by the user to mount a different outboard motor to the boat.

Figure 4:
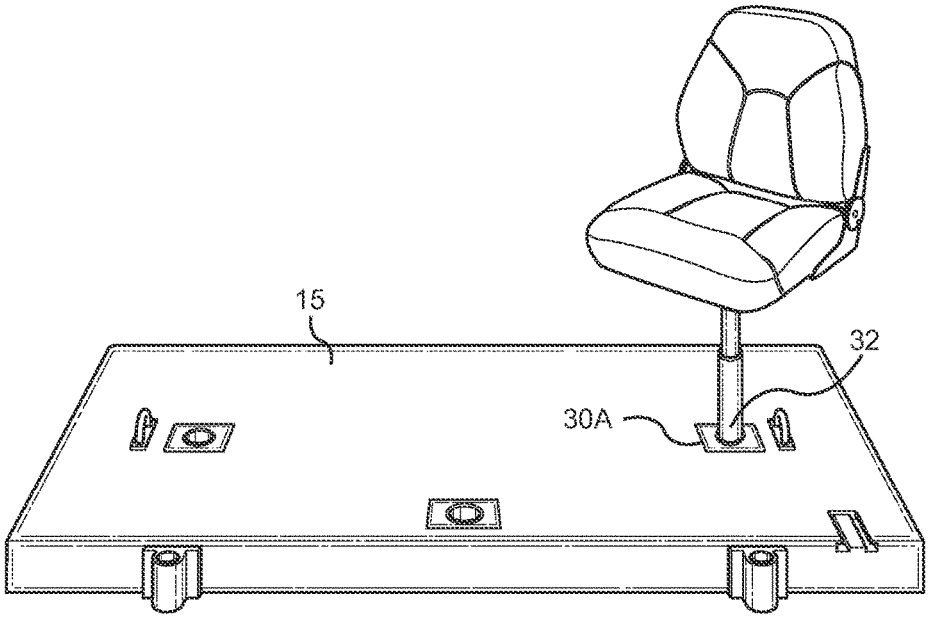
FIG. 4 shows a perspective view of an embodiment of the present invention, wherein a pedestal fishing chair is mounted onto a pedestal mount.
Figure 5:
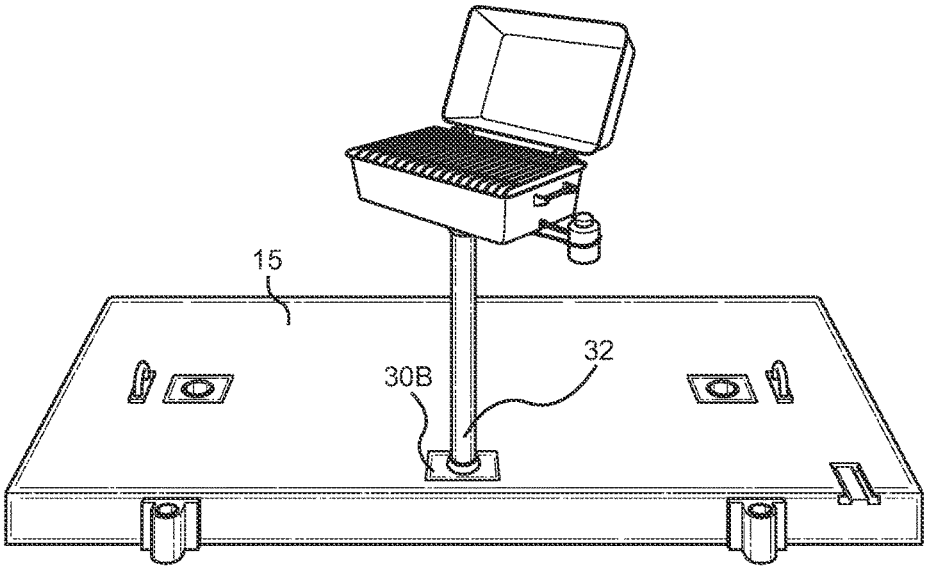
FIG. 5 shows a perspective view of an embodiment of the present invention, wherein a pedestal grill is mounted onto a pedestal mount.

Referring now to FIGS. 4 and 5, there are shown views of an embodiment of the present invention, displaying various interchangeable accessories mounted to the platform. The pedestal mounts 30A, 30B are flush to the surface of the platform 15 and comprises a female receiver configured to engage with a male end 32 of an interchangeable accessory. The interchangeable accessory includes a pedestal fishing chair as depicted in FIG. 4, a pedestal grill as depicted in FIG. 5, a pedestal food preparation table, and any other such accessory having a male end configured to engage with the pedestal mounts 30A, 30B. The flush mounted nature of the pedestal mounts 30A, 30B helps prevent a tripping hazard to users. The male end of the interchangeable accessory comprises a locking or detent pin that is configured to engage and lock a pedestal mount. In a second embodiment, the interchangeable accessory comprises a taper lock mechanism that is configured to engage with a pedestal mount. In a third embodiment, the interchangeable accessory comprises a screw-in locking mechanism that is configured to engage with a pedestal mount.

Figure 6:
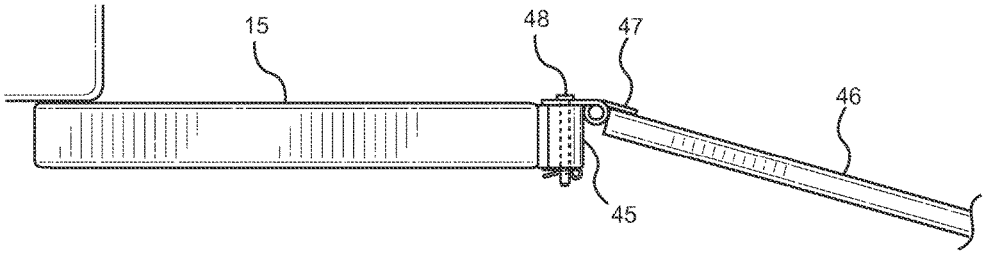
FIG. 6 shows a starboard side view of one embodiment of the present invention, displaying a forward ramp mounted onto the platform via mounting eyelets.

Referring now to FIG. 6, there is shown a side view of a forward ramp 46 mounted onto the platform 15 via the platform mounting bracket in one embodiment of the present invention. In the depicted embodiment, the mounting bracket comprises mounting eyelets 45. The mounting eyelets 45 are disposed on the platform 15 and comprise a pin hole configured to receive a locking pin 48. The forward ramp 46 contains a piano hinge 47 comprising pin holes configured to correspond to the pin holes on the mounting eyelets 45 and also configured to receive the locking pin 48. When the forward ramp 46 is mounted onto the mounting eyelets 45, the pin holes on the piano hinge 47 are aligned over the corresponding pin holes on the mounting eyelets 45 such that a locking pin 48 is insertable therethrough, locking the forward ramp 46 to the platform 15. The forward ramp 46 creates a ramp for handicapped individuals to access the platform or walk on access from a dock.

Figure 7:
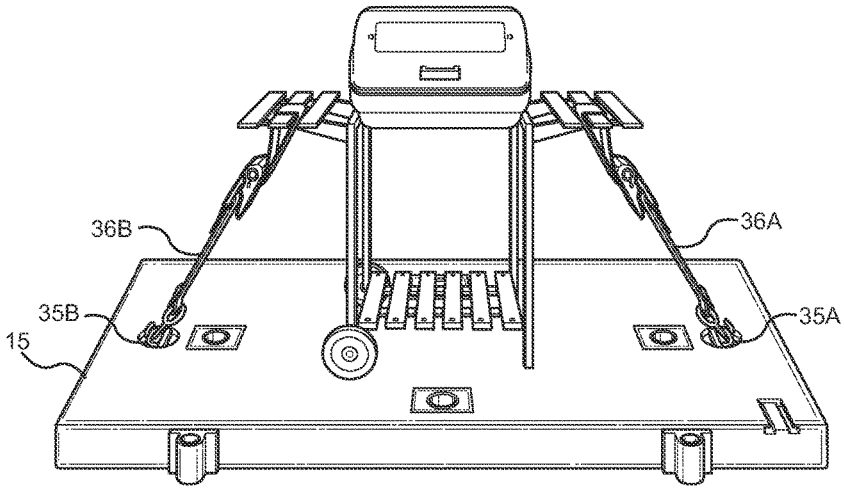
FIG. 7 shows a perspective view of an embodiment of the present invention, which displays a grill fastened to the platform using the strap connectors.

Referring now to FIG. 7, there is shown a perspective view of one embodiment of the present invention, which further comprises strap connectors. The strap connectors can be used in conjunction with ratchet straps, tie down straps and bungie cords to secure objects, such as a grill as shown, therebetween. In the depicted embodiment, the strap connectors are flush to the platform. In alternative embodiments, they can be protrusive. The strap connectors are being utilized to fasten an item to the platform. The depicted strap connectors comprise two flush-mounted D-rings 35A, 35B, which are being utilized to fasten a grill using two ratchet straps 36A, 36B. Each D-ring 35A, 35B receives a ratchet strap 36A, 36B, which is then hooked onto the item. The ratchet straps are then adjusted accordingly to fasten the item to the platform 15. Once the items are fastened to the platform 15, they are ready for transportation. In alternative embodiments, the strap connectors comprise buckles, utility loops and other like connectors known in the art.

Figure 8:
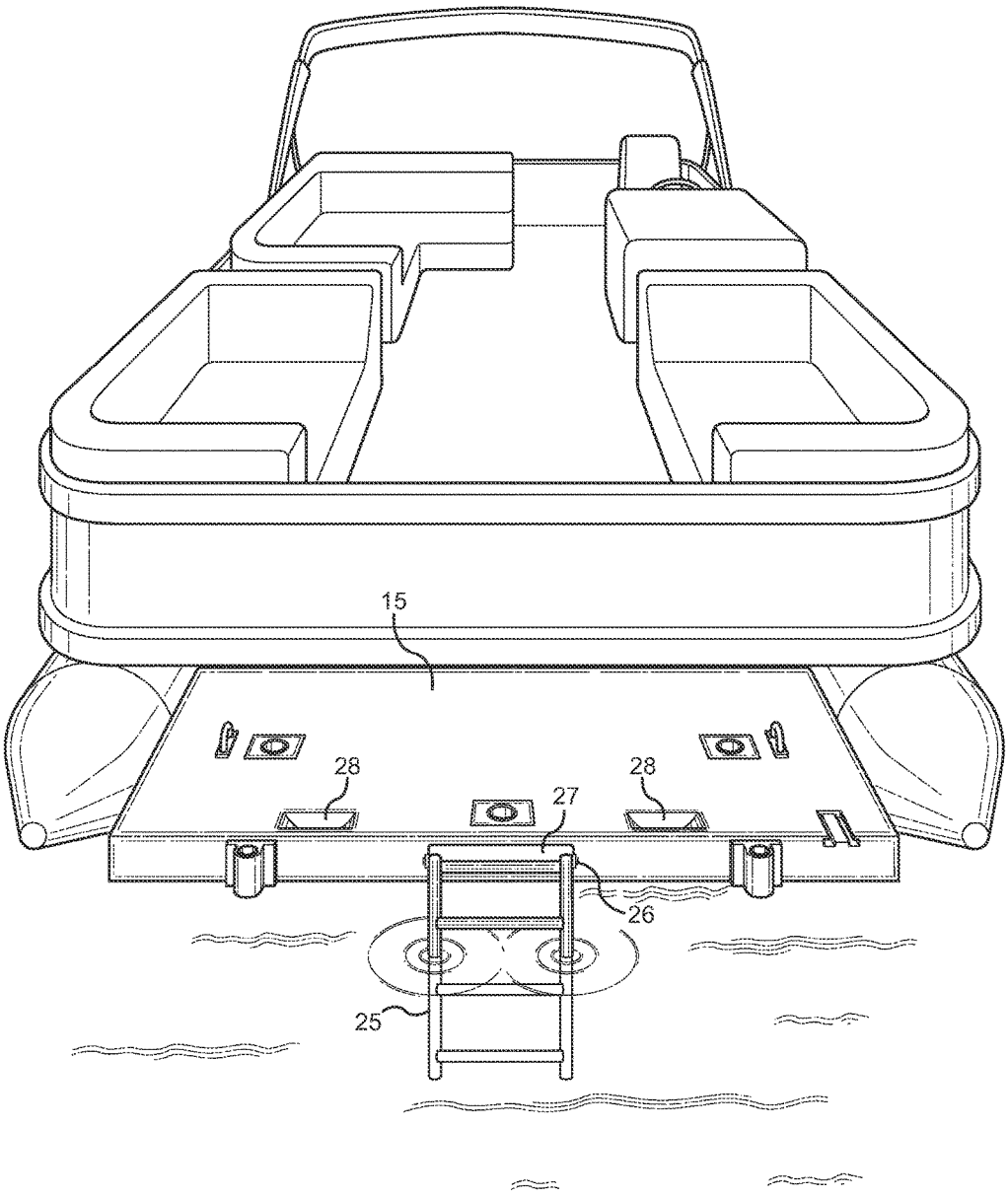
FIG. 8 shows a perspective view of a second embodiment of the present invention, which displays the stowable ladder in use, the hand grips, and universal outboard motor mount.

Referring now to FIG. 8, there is shown a perspective view of one embodiment of the present invention in use. In the depicted embodiment, the platform 15 further comprises a stowable ladder 25 hingedly connected to the platform 15 via a hinge 26. The hinge 26 is slidably disposed along the interior surface of a ladder compartment 27, thereby allowing the ladder 25 to be stowed within the interior volume of the ladder compartment 27. The interior volume of the ladder compartment 27 is equal to or greater than the volume occupied by the ladder 25 so that the ladder 25 can be received therein without extending beyond the open end of the ladder compartment 27. The ladder compartment 27 is located on the distal side of the platform 15, opposite to the side of the platform 15 that is nearest to the boat deck. When not in use, the ladder 25 can be stowed by pivoting the ladder 25 about the hinge 26 to position it parallel to the platform 15 and then sliding it into the ladder compartment 27. The hand grip 28 can be utilized in conjunction with the stowable ladder 25 to aid a person in exiting the water.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pontoon boat extension, comprising:

a platform;

a mounting rail disposed on the platform, the mounting rail configured to slidably engage with a mounting bracket on a boat hull;

a sliding mechanism comprising an actuator, the actuator configured to slidably adjust the platform relative to the boat hull via the mounting bracket;

a pedestal mount disposed on the platform, the pedestal mount configured to removably receive an interchangeable accessory;

an outboard motor mount disposed on the platform, the outboard motor mount configured to receive an outboard motor;

wherein the outboard motor mount is flush to the platform;

wherein the outboard motor mount comprises a pair of channels separated by an interior portion;

a mounting bracket disposed on the platform;

a stowable ladder hingedly connected to the platform; and wherein the ladder is configured to stow within a ladder compartment disposed within the platform.

2. The pontoon boat extension of claim 1, wherein the platform further comprises a strap connector disposed on the platform, wherein the strap connector is configured to removably receive a strap.

3. The pontoon boat extension of claim 1, wherein the platform further comprises hand grips disposed on the platform.

4. The pontoon boat extension as claimed in claim 1, wherein the actuator comprises a hand grip disposed on the platform.

5. The pontoon boat extension as claimed in claim 1, wherein the actuator comprises an electric motor.

6. The pontoon boat extension as claimed in claim 1, wherein the actuator comprises a pneumatic motor.

7. The pontoon boat extension as claimed in claim 1, wherein the mounting bracket comprises opposing first and second mounting eyelets.

8. The pontoon boat extension as claimed in claim 7, wherein the mounting eyelets are configured to removably receive a forward ramp.

9. The pontoon boat extension as claimed in claim 1, wherein the interchangeable accessory comprises a grill.

10. The pontoon boat extension as claimed in claim 1, wherein the interchangeable accessory comprises a food preparation table.

11. The pontoon boat extension as claimed in claim 1, wherein the interchangeable accessory comprises a chair.

12. The pontoon boat extension as claimed in claim 1, wherein the pedestal mounts are flush to the platform.

13. The pontoon boat extension as claimed in claim 2, wherein the strap connecter is flush to the platform.

14. The pontoon boat extension as claimed in claim 1, wherein the pair of channels further comprise at least one mounting hole configured to receive a fastener therein.

15. The pontoon boat extension as claimed in claim 7, wherein the mounting eyelets comprise tubular members mounted vertically on an edge of the platform.

16. A pontoon boat extension, comprising:

a platform;

a mounting rail disposed on the platform, the mounting rail configured to slidably engage with a mounting bracket on a boat hull;

a sliding mechanism comprising an actuator, the actuator configured to slidably adjust the platform relative to the boat hull via the mounting bracket;

a pedestal mount disposed on the platform, the pedestal mount configured to removably receive an interchangeable accessory;

an outboard motor mount disposed on the platform, the outboard motor mount configured to receive an outboard motor; and a mounting bracket disposed on the platform;

wherein the mounting bracket comprises opposing first and second mounting eyelets;

wherein the mounting eyelets comprise tubular members mounted vertically on an edge of the platform;

a stowable ladder hingedly connected to the platform;

wherein the ladder is configured to stow within a ladder compartment disposed within the platform.

17. The pontoon boat extension of claim 16, wherein the outboard motor mount is flush to the platform.

18. The pontoon boat extension of claim 17, wherein the outboard motor mount comprises a pair of channels separated by an interior portion.

19. The pontoon boat extension of claim 18, wherein the pair of channels further comprise at least one mounting hole configured to receive a fastener therein.

20. The pontoon boat extension of claim 16, wherein the mounting eyelets comprise tubular members mounted vertically on an edge of the platform.

* * * * *